United States Patent [19]

Littlehorn

[11] Patent Number: 4,815,346

[45] Date of Patent: Mar. 28, 1989

[54] MULTI-PURPOSE TOOL

[76] Inventor: John Littlehorn, P.O. Box AN, Jackson, Calif. 95642

[21] Appl. No.: 889,639

[22] Filed: Jul. 28, 1986

[51] Int. Cl.[4] ..... B25B 23/00

[52] U.S. Cl. ..... 84/439; 81/440; 81/124.5; 81/177.4

[58] Field of Search ..... 81/440, 437, 438, 439, 81/124.5, 177.4, 490, 492, 450

[56] References Cited

U.S. PATENT DOCUMENTS

| | | | |
|---|---|---|---|
| 1,230,173 | 6/1917 | Kremer | 81/450 |
| 4,327,790 | 5/1982 | Stevens et al. | 81/440 |
| 4,440,048 | 4/1984 | Stevens et al. | 81/440 |
| 4,476,751 | 10/1984 | Mishima | 81/440 |

FOREIGN PATENT DOCUMENTS

| | | | |
|---|---|---|---|
| 64530 | 1/1892 | Fed. Rep. of Germany | 81/440 |
| 464002 | 7/1928 | Fed. Rep. of Germany | 81/440 |

*Primary Examiner*—James G. Smith
*Attorney, Agent, or Firm*—Mark C. Jacobs

[57] ABSTRACT

A multi-purpose portable and collapsible hand tool including a main barrel having a plurality of differing blades or bits. Each blade or bit is pivotally mounted on the barrel with at least one end cap closing off one end of the barrel where the blades or bits are pivotally connected to the barrel. The end cap is rotatably mounted to the respective barrel end and includes an elongated slot so that a blade or bit, normally disposed against the barrel and lying substantially parallel to the longitudinal axis of the barrel, is prevented from pivoting away from the barrel until the end cap preventing said pivoting is rotated to align its slot with a blade or bit so that the blade or bit may be pivoted away from the barrel to a position extending parallel to the longitudinal axis of said barrel, said end cap being rotatable to prevent said blade or bit from pivoting back against the barrel, i.e. to lock the blade or bit into operative position.

9 Claims, 3 Drawing Sheets

MULTI-PURPOSE TOOL

BACKGROUND OF THE INVENTION

1. Field of the Invention

The invention relates to hand tools, and, more particularly, to a small multi-purpose hand tool having a plurality of bits or blades, such as a screw driver blade or a punch.

2. Description of the Prior Art

Multi-purpose hand tools are well known in the tool art. However, many such tools are impractical since they do not allow sufficient torque and leverage in use. One such tool is disclosed in U.S. Pat. No. 4,440,048 to Stevens et al. However, in this device, the individual blades are pivotally connected at the middle and off-center from the center axis. Thus, torque durability and strength are sacrificed and the leverage is not as good as is provided by a blade located at the ends and extending along the central axis of the main body portion, as in the tool of this invention.

Another such tool is disclosed in U.S. Pat. No. 3,186,009 to Simmons. However, the various blades are pivotally connected at the middle and extend normal to the main body which makes the tool awkward to use and impractical since sufficient torque and leverage is not obtained both of these tools incorporate a longer handle and a shorter bit to accommodate collapsibility, resulting in an abnormal and awkward tool.

There is a need for a multi-purpose tool having differing screw driver blades or bits for various screw configurations or for punching operations or the like. Such a tool should have sufficient torque to turn such screws or the like and to enable the user to put good leverage on the screws. The need to carry a number of different screw drivers or hand tools is eliminated. Such a tool should have the blades or bits connected to the tool body and not loose, and have means for locking the blade or bit being used to ensure stability in use.

SUMMARY OF THE INVENTION

It is an object of this invention to provide an improved portable and collapsible hand tool having a plurality of blades or bits which can be selected for use and to provide sufficient torque and leverage when used.

It is a further object of this invention to provide a portable hand tool having a plurality of blades or bits, each being pivotally connected to the tool at the ends thereof with one or more rotatable end caps overlying the blade or bit ends to prevent the blades or bits from pivoting away from the tool body when in a first position, allowing the blade to pivot away from the tool body when in a second position and locking the pivoted blade in a position extending parallel to the coincident with the longitudinal axis of the tool body in a direction away therefrom when rotated to a third position.

These and other objects are preferably accomplished by providing a multi-purpose portable and collapsible hand tool including a main barrel having a plurality of differing blades or bits. Each blade or bit is pivotally mounted on the barrel with at least one end cap closing off one end of the barrel where the blades or bits are pivotally connected to the barrel. The end cap is rotatably mounted to the respective barrel end and includes an elongated slot so that a blade or bit, normally disposed against the barrel and lying substantially parallel to the longitudinal axis of the barrel, is prevented from pivoting away from the barrel until the end cap preventing said pivoting is rotated to align its slot with a blade or bit so that the blade or bit may be pivoted away from the barrel to a position extending parallel to he longitudinal axis of said barrel, said end cap being rotatable to prevent said blade or bit from pivoting back against the barrel.

DESCRIPTION OF THE PREFERRED EMBODIMENTS

Figure 1:
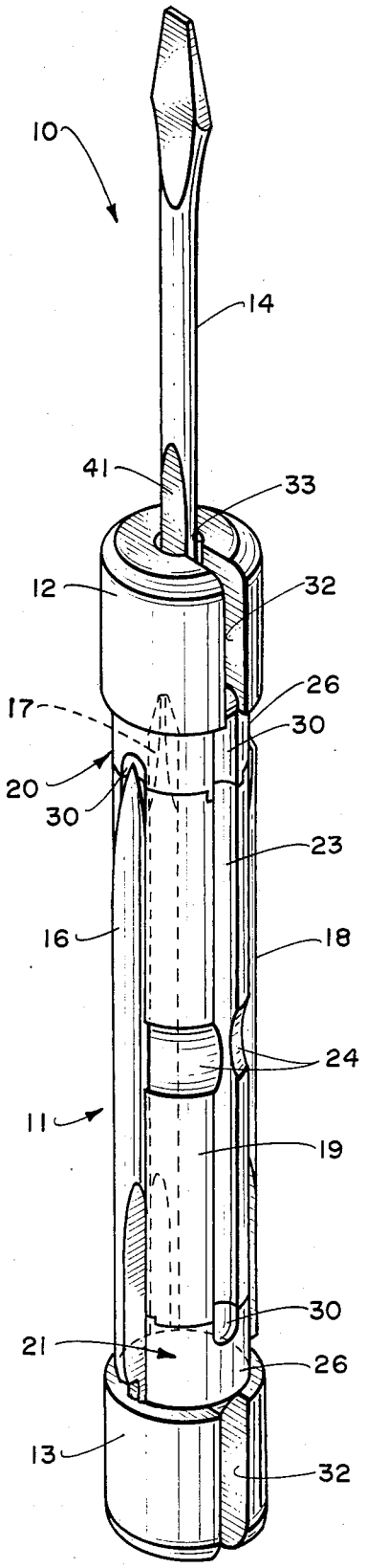
FIG. 1 is a perspective view of a hand tool in accordance with the teachings of the invention showing one blade in stored position and one blade in an intermediate position.

Referring now to FIG. 1 of the drawing, a hand tool 10 is shown having a main body portion 11 closed off at each end by end caps 12, 13. A plurality of blades or bits, such as blades 14 through 18, are shown mounted to body portion 11. Each blade 14 through 18 may differ from the other and terminate in blade ends specifically designed for various screws, phillips slot screws, etc. Further, one or more of the blades may terminate in an awl or pointed end, if desired.

Figure 2:
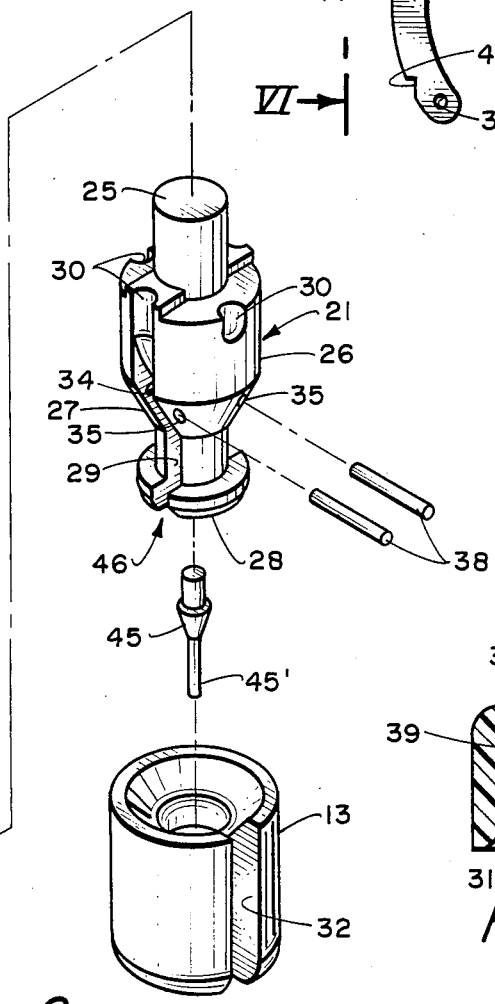
FIG. 2 is an exploded view of the tool of FIG. 1.

End caps 12, 13 and main body portion 11 are shown in exploded view in FIG. 2, with the various blades 14 through 18 being omitted for convenience of illustration. Main body portion 11 is comprised of three parts, a generally cyindrical mid section 19 and end closure caps 20, 21. Mid section 19 may have a central hole 22 and a plurality of elongated shallow grooves 23 extending along mid section 19. Recesses 24 or reduced areas are provided abou the middle of mid section 19 extending into the grooves 23 for grasping the various blades.

End closure caps 20, 21 are identical and each includes a generally cylindrical portion 25 adapted to snap fit into hole 22 in mid section 19 and each is generally similar in diameter thereto. A larger diameter cylindrical section 26 is integral with portion 25 and has a tapered portion 27 leading to and integral with a generally cylindrical terminal end 28. A plurality of elongated slots 29 extend along terminal end 28, tapered portion 27 and a portion of section 26 as shown. Preferably, there are at least a plurality of slots 29 in both caps 20, 21 related to the total number of grooves 23. A plurality of grooves 30 may be provided in each cap 20, 21 adapted to received the terminal ends of blades 14 through 18 if either of these blades is of a length sufficient to extend and overlie each cap 20, 21 to rest in such grooves 30.

Figure 3:
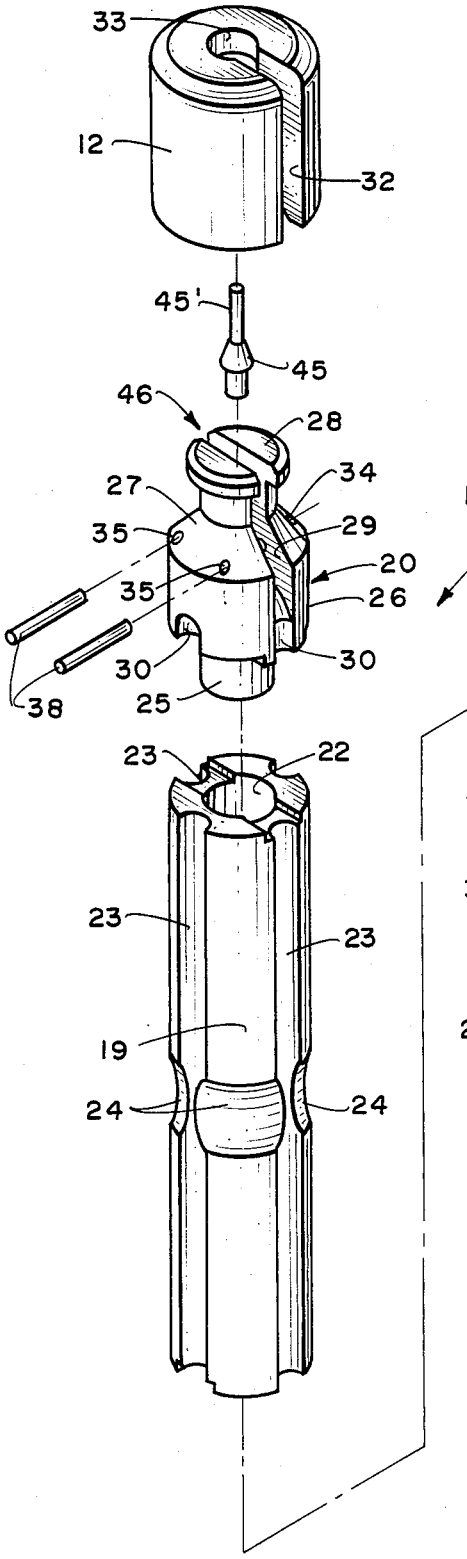
FIG. 3 is a view of one of the blades alone of the tool of FIG. 1.
Figure 3:
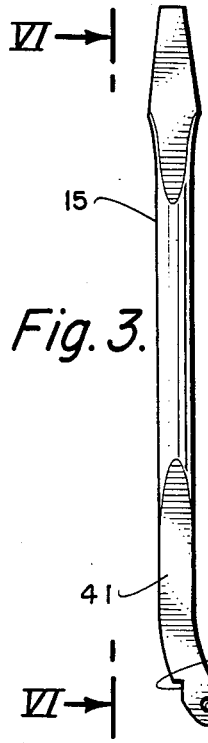

End caps 12, 13 (FIGS. 1, 2 and 5) are identical and each is generally cylindrical including a central hole 31 opening, main section 11. An elongated slot 32 extends along each cap 12, 13 terminating at hold 33 which hole 33 is co-axially aligned with the central axis of hole 31. An internal groove 39 is provided in the interior wall of each end cap 12, 13 adjacent hole 33. As seen in FIG. 2, aligned holes 34, 35 extend through tapered portion 27 for receiving a pivot pin 38 (see FIG. 4—to be discussed) extending through a hole 36 (FIG. 3) in each of the blades, such as blade 14, to retain the blade in end caps 20, 21 while allowing the same to pivot within each slot 29. As seen in FIG. 3, each blade terminateds in a curved end 37 which pivots within slot 29.

Figure 4:
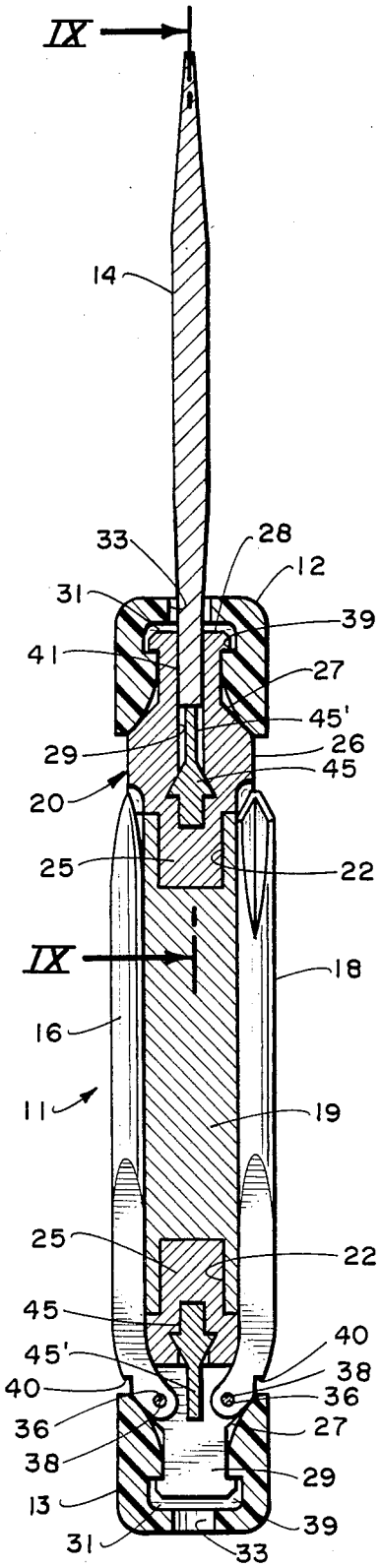
FIG. 4 is a cross-sectional view of the tool of FIG. 2.

As seen in FIG. 4, each end closure cap 20, 21 is snap fit onto mid section 19 with portions 25 snap fitting into hole 22 with slots 29 aligned with grooves 23. Per FIG. 4, a blade, such as blade 14, is now inserted into slot 29 and pin 38 is inserted into aligned holes 34 through 36 to retain blade 14 pivotally therein. Of course, the remaining blades are installed in like manner. End caps 12, 13 are now snap fit over the ends 28 with said ends 28 snap fitting into interior grooves 39 (FIG. 5) in each end cap 12, 13. Caps 12, 13 are rotatably disposed about the end closure caps 20, 21.

Of course, any suitable means may be used for assembly of the various components and securing them together. For example, the parts 19–21 may be pinned together after assembly.

In operation, and referring again to FIG. 1, blade 14 is shown extending coincident to the central longitudinal axis of section 19. Slot 32 in end cap 12 is positioned such that blade 14 can be pivoted back. Rotation of cap 12 would misalign slot 32 with blade 14 to prevent this. Blade 14 can now be used without danger of pivoting back and good torque and leverage can be placed on the tool. Realignment of slot 32 with the groove 23 for blade 14 allows blade 14 to be pivoted back into its groove (as blades 16–18). Blade 14 is shown in an intermediate position within slot 32. In this manner, each blade may be selectively presented for use and locked in position merely by rotating end caps 12, 13.

There is greater leverage and torque in the tool of the invention than known prior art tools. The various parts can be simply and easily machined or cast and can be made of economical materials, such as cast metals and plastics (except for the blades or bits which are preferably of metal). Any number, type, size or length of blades or bits can be provided limited only by the tool proportions, such as its diameter and length. The bit or blade being used in its operative position rests on a bit and or backing pin and end cap to provide firm support.

Figure 6:
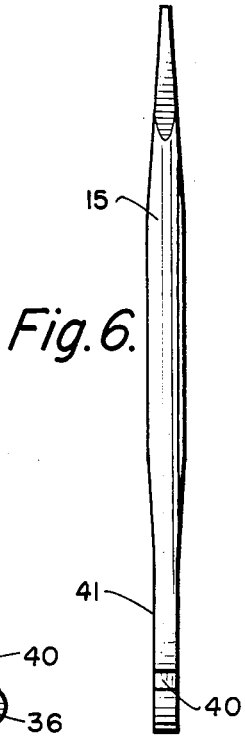
FIG. 6 is a view taken along lines VI—VI of FIG. 3.
Figure 5:
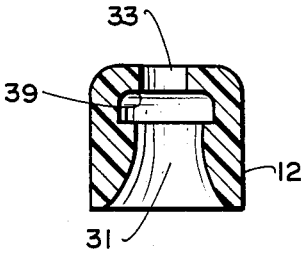
FIG. 5 is a cross-sectional view of one of the components of the tool of FIG. 1.

The tool may have either one or two end caps. As seen in FIG. 5, opening 31 is curved or tapered and bears down against the blades or bits as it rotates. As seen in FIG. 6, a pressure bearing notch 40 is provided on the outside of each bit or blade where it curves or bends, such as at an angle of about 45 degrees. These notches 40 correspond to an indent 41 (FIG. 4) formed on the interior walls of the terminal ends 28 at slots 29 and combine to form greater durability and strength by keeping pressure off of the pins 38, which secure bits or blades to the end caps 20, 21. The tool is of course collapsible, compact and easily carried in a person's pocket or purse.

Figure 9:
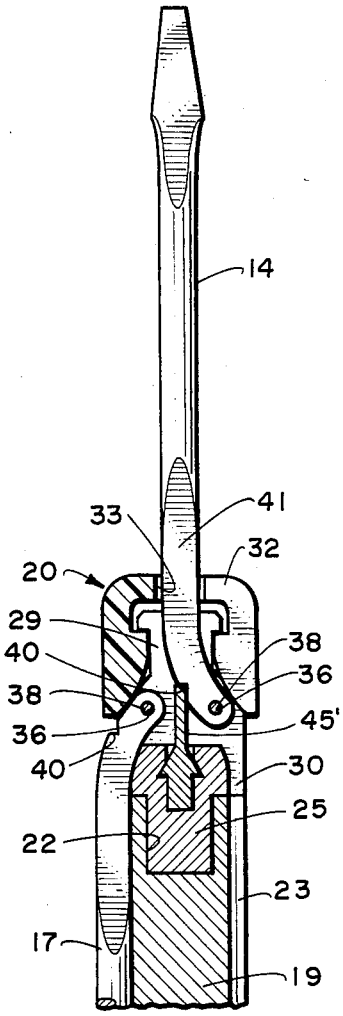
FIG. 9 is a view similar to FIG. 8 but with blade in vertical position taken along line IX—IX of FIG. 4.
Figure 8:
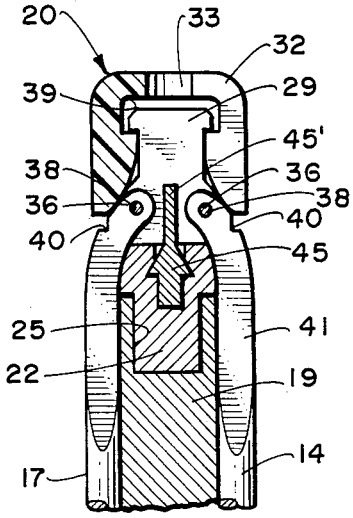
FIG. 8 is a cut away view of a portion of a variant of this invention.

Turning now to FIGS. 8 and 9, which is a partial cutaway view of a variant of this invention. Seen here is a smaller version of the device of this invention, as is seen in FIG. 1. The intersection of the blade or bit's angled portion with the remaining straight portion is notched. Also the closure cap 20, 21 is indented at its slot where the blade or bit pivots in order to provide a pressure bearing surface for the said blade or bit. The backing pin 45 has an extended portion 45′ which engages a notch 14′ as would be found in all of the other blades or bits present.

Pin 45 is seen to be disposed within the central slot 46 of end closure 20, 21 which slot is best seen in FIG. 2.

This pin 45 can either be machined or cast into the end cap 20 to be integral, or disposed therein by friction fit, if made as a separate component. Thus FIG. 9 is a 90 degree cross section based on FIG. 4.

Figure 7:
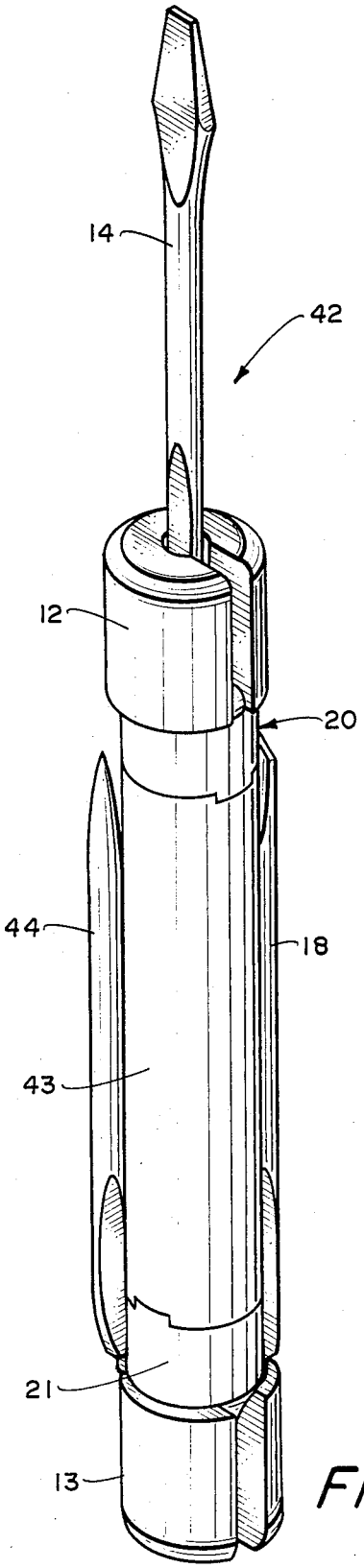
FIG. 7 is a view similar to FIG. 1 showing a modification of the invention.

Although a preferred embodiment of the invention has been disclosed as having grooves for receiving the various blades therein, as seen in FIG. 7, a tool 42 is shown otherwise identical to tool 10 of FIGS. 1 to 6 except that the mid section 43 is smooth surfaced and the various bits or blades merely overlie and lay against the section 43 (as blade 44).

Of course, either section 19 or 43 may be tapered and have either one or two end caps and related apparatus.

It can be seen that there is disclosed a hand tool that can be carried in one's pocket, used to quickly select a desired blade or bit tip, then used to operate a screw or make a hole or the like with sufficient torque and leverage to handle the most stubborn job.

Since certain changes may be made in the above device without departing from the scope of the invention herein involved, it is intended that all matter contained in the above description and shown in the accompanying drawings shall be interpreted as illustrative and not in a limiting sense.

I claim:

1. In a collapsible portable hand tool device having a plurality of blades or bits with varying tips hereon, said device having a main body portion providing a handle, and the plurality of blades or bits being spaced about the main body portion and pivotable from a first stored position overlying and adjacent to the main body portion to a second operative position extending away from the main body portion, the improvement which comprises:

said main body portion being smooth walled on its outer surface, having at least one slotted closure cap, said cap having one end of each of said bits or blades pivotally mounted therein, said one end being at an angle with respect to the remaining portion of said blade or bit, and an end cap rotatable mounted over said closure cap having at least one slot therein with a concentric opening in said end cap aligned with the central longitudinal axis of said main body portion, said opening communicating with said slot and concentric in said end cap whereby, when said slot in said end cap is aligned with the slot in said closure cap, a first pivotally mounted bit or blade can pivot from its first position stored abuttingly against said smooth walled outer surface of said main body portion to its second operative position extending in a direction away from said main body portion along an axis coincident with the central longitudinal axis of said main body portion and out of the opening in said end cap; said end cap being rotatable to move its slot out of alignment with the slot in said closure cap thereby preventing said bit or blade from pivoting back to its first stored position until the slot in said end cap is realigned with the slot in said closure cap and when said end cap's slot is not in alignment with the slots in said closure cap for each of the remainder of the plurality of said bits or blades, each of the remainder of the plurality of said bits or blades is retained by said end cap abuttingly against said smooth walled outer surface and further including a backing pin, and wherein said blade or bit at the intersection of its angled portion with its remaining straight portion is notched and said closure cap is indented at its slot where said bit or blade pivots so as to provide a pressure bearing surface for the blade or bit.

2. In the tool of claim 1 including a second closure cap and a second blade or bit pivotally mounted therein and closed off by a second rotatable end cap on the side of said main body portion opposite said side having said first-mentioned closure cap and end cap thereon.

3. In the device of claim 1 including a second slot in said closure cap having a second blade or bit pivotally mounted therein.

4. In the device of claim 1 wherein said closure cap includes a flange on the outer end thereof snap fitting into a groove on the internal wall of said end cap.

5. In the device of claim 1 wherein said end cap has a concentric curved inner wall adjacent said closure cap bearing against said blade or bit when said end cap is rotated.

6. In the device of claim 1 wherein said angled portion is at an angle of about 45 degrees.

7. In the tool of claim 2 wherein each of said first and second closure caps has a second blade or bit pivotably mounted therein and each closure is closed off by its own rotatable end cap.

8. In the device of claim 7 wherein one of said closure caps has a pair of bits, and the other of said closure caps has a pair of blades pivotably therein.

9. In the device of claim 1 wherein there are two end caps, one at each end of said device, and each end cap has a curved inner wall adjacent said closure cap bearing against said blade a bit when said end cap is rotated.

* * * * *